US010266779B2

(12) United States Patent
Weiss et al.

(10) Patent No.: US 10,266,779 B2
(45) Date of Patent: Apr. 23, 2019

(54) CONVERSION PROCESS COMPRISING AT LEAST ONE STEP FOR FIXED BED HYDROTREATMENT AND A STEP FOR HYDROCRACKING IN BY-PASSABLE REACTORS

(71) Applicant: IFP Energies nouvelles, Rueil-Malmaison (FR)

(72) Inventors: Wilfried Weiss, Valencin (FR); Elodie Tellier, Lyons (FR); Pascal Chatron-Michaud, Lyons (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 28 days.

(21) Appl. No.: 15/616,418

(22) Filed: Jun. 7, 2017

(65) Prior Publication Data

US 2017/0355914 A1 Dec. 14, 2017

(30) Foreign Application Priority Data

Jun. 9, 2016 (FR) ..... 16 55287

(51) Int. Cl.

| | |
|---|---|
| ***C10G 45/08*** | (2006.01) |
| ***C10G 47/12*** | (2006.01) |
| ***C10G 49/04*** | (2006.01) |
| ***C10G 65/12*** | (2006.01) |
| ***C10G 67/02*** | (2006.01) |
| ***C10G 65/04*** | (2006.01) |
| ***C10G 7/06*** | (2006.01) |

(52) U.S. Cl.

CPC ..... *C10G 67/02* (2013.01); *C10G 7/06* (2013.01); *C10G 45/08* (2013.01); *C10G 47/12* (2013.01); *C10G 65/04* (2013.01); *C10G 65/12* (2013.01); *C10G 2300/1077* (2013.01); *C10G 2300/202* (2013.01); *C10G 2300/205* (2013.01)

(58) Field of Classification Search

CPC ..... C10G 45/08; C10G 47/12; C10G 49/04; C10G 65/12

See application file for complete search history.

(56) References Cited

U.S. PATENT DOCUMENTS

| | | | | |
|---|---|---|---|---|
| 4,446,008 | A * | 5/1984 | Shimakawa | C10G 47/20 208/111.15 |
| 5,089,463 | A * | 2/1992 | Johnson | B01J 23/85 502/313 |
| 7,651,604 | B2 | 1/2010 | Ancheyta Juarez et al. | |
| 2007/0187294 | A1 | 8/2007 | Ancheyta Juarez et al. | |
| 2014/0332444 | A1 * | 11/2014 | Weiss | C10G 65/04 208/88 |

FOREIGN PATENT DOCUMENTS

| | | |
|---|---|---|
| FR | 2983866 A1 | 6/2013 |
| FR | 3013723 A1 | 5/2015 |

OTHER PUBLICATIONS

Search Report for FR1655287 dated Jan. 30, 2017.
English Abstract of FR3013723, Publication Date: May 29, 2015.

* cited by examiner

*Primary Examiner* — Randy Boyer
(74) *Attorney, Agent, or Firm* — Millen, White, Zelano and Branigan, P.C.

(57) ABSTRACT

The invention concerns a process for the treatment of a hydrocarbon feed in order to obtain a heavy hydrocarbon fraction with a low sulphur content, said process comprising the following steps: a) an optional step for hydrodemetallization carried out in permutable reactors, b) a step for fixed bed hydrotreatment of the effluent obtained from step a), c) a step for hydrocracking of the effluent obtained in step b) in by-passable reactors, d) a step for separation of the effluent obtained from step c).

15 Claims, 2 Drawing Sheets

Figure 1:
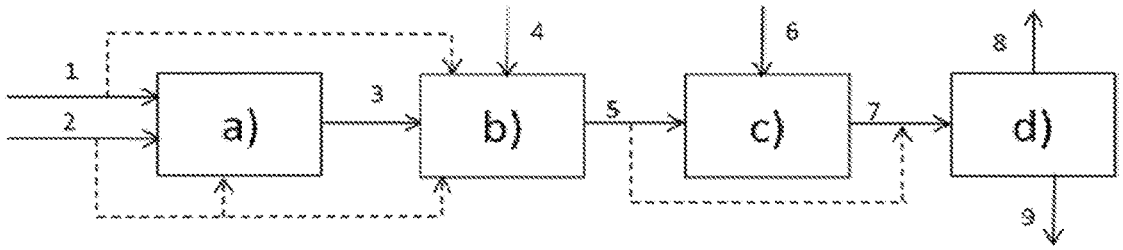

CONVERSION PROCESS COMPRISING AT LEAST ONE STEP FOR FIXED BED HYDROTREATMENT AND A STEP FOR HYDROCRACKING IN BY-PASSABLE REACTORS

CONTEXT OF THE INVENTION

The present invention relates to refining and to the conversion of heavy hydrocarbon fractions containing sulphur-containing impurities, inter alia. More particularly, it relates to a process for the conversion of heavy oil feeds of the atmospheric residue and/or vacuum residue type for the production of heavy fractions for use as fuel oil bases, in particular bunker fuel bases, with a low sediments content. The process in accordance with the invention can also be used to produce atmospheric distillates (naphtha, kerosene and diesel), vacuum distillates and light gases (C1 to C4).

The quality requirements for marine fuels are described in ISO standard 8217. The specification concerning sulphur will from now on concern the emissions of $SO_x$ (Annexe VI of the MARPOL convention from the International Maritime Organisation). It is translated as a recommendation for a sulphur content of 0.5% by weight or less outside the Emission Control Areas (ECA) for 2020-2025, and 0.1% by weight or less within the ECAs. Another very restrictive recommendation is the sediments content after aging in accordance with ISO 10307-2 (also known as IP390), which must be 0.1% or less.

The sediments content in accordance with ISO 10307-1 (also known as IP375) is different from the sediments content after aging in accordance with ISO 10307-2 (also known as IP390). The sediments content after aging in accordance with ISO 10307-2 is a far more restrictive specification and corresponds to the specification which applies to bunker fuels.

According to Annexe VI of the MARPOL convention, a vessel could thus use a sulphur-containing fuel oil as long as the vessel is equipped with a system for treating fumes allowing the oxides of sulphur emissions to be reduced.

The fuel oils used in maritime transport generally comprise atmospheric distillates, vacuum distillates, atmospheric residues and vacuum residues obtained from straight run distillation or obtained from refining processes, in particular hydrotreatment and conversion processes, said cuts possibly being used alone or as a mixture. However, although they are known to be suitable for heavy feeds charged with impurities, these processes produce hydrocarbon fractions which may comprise catalyst fines and/or sediments which have to be removed in order to comply with a product quality such as that for bunker fuel.

The sediments may be precipitated asphaltenes. The conversion conditions, and in particular the temperature, are such that they undergo reactions (dealkylation, polycondensation etc) resulting in their precipitation. In addition to the sediments existing in the heavy cut at the outlet from the process (measured in accordance with ISO 10357-1, also known by the name IP375), depending on the conversion conditions, sediments called potential sediments which only appear after a physical, chemical and/or thermal treatment also exist. All sediments including potential sediments are measured using ISO 10357-1, also known by the name IP390. These sedimentation phenomena generally arise when employing severe conditions (high temperature and dwell time), giving rise to high degrees of conversion, for example more than 35%, 40% or 50% or even higher, and also as a function of the nature of the feed. The formation of potential and/or existing sediments also has a tendency to increase with aging of the catalysts.

The degree of conversion is defined as the fraction by weight of organic compounds with a boiling point of more than 520° C. in the feed at the inlet to the reaction section minus the fraction by weight of organic compounds in the effluent with a boiling point of more than 520° C. at the outlet from the reaction section, all divided by the fraction by weight of organic compounds in the feed with a boiling point of more than 520° C. at the inlet to the reaction section. In the processes for the treatment of residues, there is an economic benefit in maximizing the conversion because in general, the conversion products, in particular distillates, are easier to upgrade than the feed or the unconverted fraction.

In fixed bed hydrotreatment processes, the temperature is generally lower than in ebullated bed or slurry bed type hydrocracking processes. The degree of conversion in fixed bed mode is thus generally lower, but implementation is simpler than in an ebullated bed or slurry mode. Thus, the degree of conversion of fixed bed hydrotreatment processes is moderate to low, generally less than 45%, usually less than 35% at the end of a cycle, and less than 25% at the start of a cycle. The degree of conversion generally varies during the cycle due to the increase in temperature in order to compensate for catalytic deactivation.

In fact, sediments production is generally lower in fixed bed hydrotreatment processes than in ebullated bed or slurry type hydrocracking processes. However, the temperatures sometimes reached from the middle of the cycle and up to the end of the cycle for fixed bed processes for the hydrotreatment of residues may lead to the formation of sufficient sediments to degrade the quality of a fuel oil, in particular bunker fuel, a large part of which is constituted by a heavy fraction obtained from a fixed bed residue hydrotreatment process. The person skilled in the art is familiar with the difference between a fixed bed and a slurry bed. A slurry bed is a bed in which the catalyst is sufficiently dispersed in the form of small particles for them to be in suspension in the liquid phase.

BRIEF DESCRIPTION OF THE INVENTION

In the context described above, the Applicant has developed a novel process integrating a step for hydrocracking in by-passable reactors which can be used to increase conversion compared with conventional residue hydrotreatment processes.

The term "by-passable reactor" means a reactor which can be stopped by carrying out a by-pass while the other reactors of the unit are still operating. In contrast to reactors which are termed "permutable", which can be taken back into service while the other reactor or reactors of the unit is/are operating, by-passable reactors can be stopped at any moment and generally taken back into service only during a restart of the whole unit.

To illustrate the difference between the two types of reactors, a by-passable reactor can be removed at any time and for a period of any length from the production flow sheet, while a permutable reactor is necessarily stopped so that another can be restarted.

Clearly, the concept of by-passable reactors can be applied to a series of reactors which can be stopped and restarted, simultaneously or otherwise.

Surprisingly, it has been found that a process of this type using by-passable reactors can be used, after fractionation of hydrocarbon fractions with a low sulphur content, to obtain increased quantities of distillates and at least one liquid hydrocarbon fraction which may advantageously be used, as a whole or in part, as a fuel oil or fuel oil base. The novel process employs hydrocracking using by-passable reactors which are in service for only a part of the cycle of the unit, in order to obtain at least one heavy fraction with a low sulphur content after fractionation which satisfies future recommendations from the IMO, but in particular with a low sediments content, namely a sediments content after aging of 0.1% by weight or less.

Another advantage of the novel process integrating a step for hydrocracking using by-passable reactors is that it becomes possible to operate these by-passable hydrocracking reactors at a mean temperature throughout the cycle which is higher than that of the reactors of the fixed bed hydrotreatment section, thus resulting in a higher conversion without the formation of sediments, which generally increases at higher temperatures, being a problem for the product quality.

The temperature of the by-passable reactor necessitating stoppage of the reactor is generally in the range 390° C. to 430° C., and preferably in the range 405° C. to 425° C.

The by-passable reactor hydrocracking section is stopped so as to prevent the generation of sediments, in particular potential sediments, while at the same time allowing hydrotreatment to be continued in the upstream reactors.

Usually, the hydrocracking section is employed from the beginning of the cycle of the unit and for at least 30% of the cycle, or even at least 50% of the cycle. The stoppage temperature for the by-passable reactor hydrocracking section is to be determined by the operator, by monitoring the sediments content of the effluent, in particular that of potential sediments. As soon as the sediments content after aging (IP390) is more than 0.05% or 0.08%, for example, it is time to stop the by-passable reactor hydrocracking section.

The average temperature of the process is a weighted average of the various mean bed temperatures. It is calculated for each reactor using its mean temperature and the weight of its catalysts.

As an example, for a reactor with two beds with a mass m1 and m2 and mean temperature T1 and T2, the weighted mean temperature will be calculated as follows:

$$(T1\times m1+T2\times m2)/(m1+m2).$$

During the period from the start to approximately the middle of the cycle, deactivation of the catalysts of the hydrotreatment section is low and the catalysts are thus active at moderate temperatures, which results in the production of very stable effluents which are free from sediments; thus, there is an interest in exploiting this margin of stability by applying a by-passable reactor hydrocracking step operating at a temperature which is higher in order to produce a gain in conversion. Similarly, coking and an increase in the pressure drop are not problematic in the hydrocracking section, since the by-passable reactors can be stopped without stopping the unit, which thus means that the pressure drop of the reaction section can be reduced by subtracting the pressure drop of the by-passable reactors.

For onshore applications such as thermal power plants for the production of electricity or for the production of utilities, there are requirements as regards the sulphur content of fuel oil, with less stringent requirements for the stability and the sediments content than for bunker fuels for burning in engines.

More precisely, the invention concerns a process for the treatment of a hydrocarbon feed containing at least one hydrocarbon fraction with a sulphur content of at least 0.1% by weight, an initial boiling temperature of at least 340° C. and a final boiling temperature of at least 440° C., in order to obtain conversion products and a heavy hydrocarbon fraction with a low sulphur content. This heavy hydrocarbon fraction may be produced in an optimized manner, in a manner such that its sediments content after aging is 0.1% by weight or less. Said process comprises the following steps:

a) an optional hydrodemetallization step in permutable reactors, in which the hydrocarbon feed is brought into contact with hydrogen over a hydrodemetallization catalyst,
b) a step for fixed bed hydrotreatment of the effluent obtained from step a),
c) a step for hydrocracking the effluent obtained from step b) in by-passable reactors,
d) a step for separating the effluent obtained from step c), leading to at least one gas fraction and one liquid fraction with a sediments content after aging of 0.1% by weight or less.

One of the aims of the present invention is to propose a process which couples conversion and desulphurization of heavy oil feeds for the production of fuel oils and fuel bases with a low sulphur content.

Another aim of the process in accordance with the invention is the production of bunker fuels or bunker fuel bases, with a low sediments content, i.e. 0.1% by weight or less after aging, this being obtained by carrying out steps a), b), c) and d) during the first part of the cycle, then by stopping the by-passable reactors in the second part of the cycle.

Another aim of the present invention is to jointly produce atmospheric distillates (naphtha, kerosene, diesel), vacuum distillates and/or light gases (C1 to C4) using the same process. The naphtha and diesel type bases can be upgraded at the refinery for the production of fuels for automobiles and for aviation such as, for example, superfuels, jet fuels and diesels.

Description of FIG. 1

FIG. 1 describes a layout for the invention, without limiting its scope. The hydrocarbon feed 1 and hydrogen 2 are brought into contact in an optional step a) for hydrodemetallization carried out in permutable reactors, in which the hydrogen 2 may be introduced to the inlet to the first catalytic bed and between two beds of step a).

The effluent 3 obtained from step a) for hydrodemetallization using permutable guard reactors is sent to a fixed bed hydrotreatment step b) into which supplemental hydrogen 4 may be introduced at the inlet to the first catalytic bed and between two beds of step b).

In the case in which step a) is absent, the hydrocarbon feed 1 and hydrogen 2 are introduced directly into the hydrotreatment step b). The effluent 5 obtained from the fixed bed hydrotreatment step b) is sent to a by-passable reactor hydrocracking step c) in which supplemental hydrogen 6 may be introduced into the inlet to the first catalytic bed and between two beds of step c). When at least one reactor of the by-passable reactor hydrocracking section is stopped, this reactor is short-circuited by means of valves, i.e. the supply to this reactor is connected directly to the effluent line from this reactor. If there is only one by-passable reactor, or when all of the by-passable reactors have been stopped, the effluent 5 obtained from the fixed bed hydrotreatment step is introduced directly to the separation step d).

When at least one by-passable reactor is operating, the effluent 7 obtained from the by-passable reactor hydrocracking step c) is sent to a separation step d) in order to obtain at least one light hydrocarbon fraction 8 and a heavy fraction 9 containing compounds boiling at at least 350° C., and having a sediments content after aging of 0.1% by weight or less.

Figure 2:
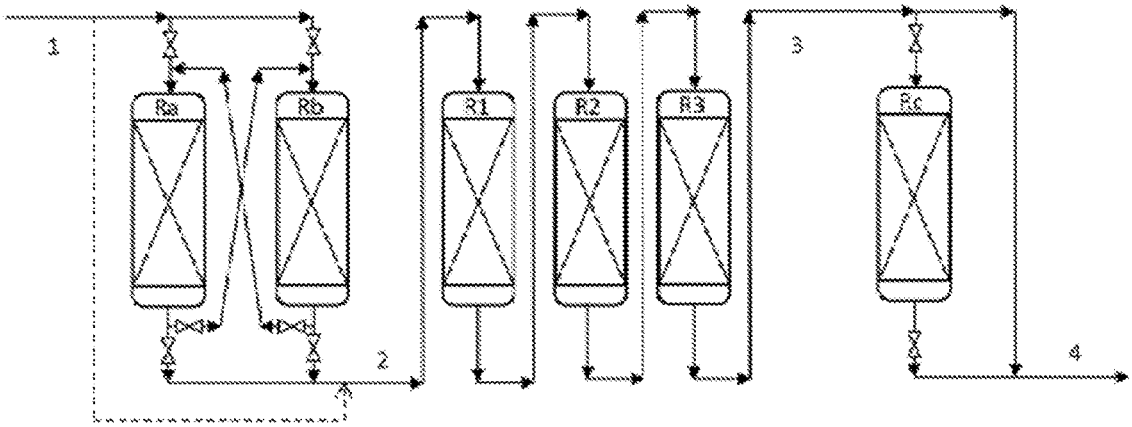

Description of FIG. 2

FIG. 2 describes a simplified layout for implementing the concatenation of reactors of the invention, without limiting the scope. For the purposes of simplicity, only the reactors are represented, but it should be understood that all of the equipment necessary for operation are present (drums, pumps, exchangers, furnaces, columns, etc). Only the principal streams containing the hydrocarbons are represented, but it should be understood that streams of hydrogen-rich gas (makeup or recycle) may be injected into the inlet to each catalytic bed or between two beds.

The feed 1 enters a hydrodemetallization step with permutable guard reactors constituted by reactors Ra and Rb. The effluent 2 from the permutable guard reactor hydrodemetallization step is sent to the fixed bed hydrotreatment step constituted by reactors R1, R2 and R3. The fixed bed hydrotreatment reactors may, for example, be charged respectively with hydrodemetallization catalysts, transition catalysts and hydrodesulphurization catalysts. Because the permutable guard reactor hydrodemetallization step is optional, the feed 1 may enter directly into the fixed bed hydrotreatment section. The effluent 3 from the fixed bed hydrotreatment step is sent to the by-passable reactor hydrocracking step represented by the reactor Rc.

Each reactor Ra, Rb, Rc may be taken off line without stopping the remainder of the unit. In contrast, only Ra and Rb, which are permutable reactors, may be stopped in order to change the catalyst then restarted without stopping the rest of the unit. This change in catalyst (rinsing, discharging, recharging, sulphurization and restarting) is generally carried out by means of a conditioning section, not shown. The reactor Rc is stopped during the cycle without stopping the rest of the unit, but can only be restarted after complete stoppage of the unit, this stoppage being with the aim of discharging and recharging all of the deactivated catalysts.

The following table provides an example of sequences which can be carried out in accordance with FIG. 2:

| | Permutable hydrodemetallization reactors | | | Fixed bed hydrotreatment | | | By-passable hydrocracking reactors | |
|---|---|---|---|---|---|---|---|---|
| Sequences | Off line | HDM1 | HDM2 | HDM | Transition | HDS | Off line | HCK1 |
| 1 | — | Ra | Rb | R1 | R2 | R3 | — | Rc |
| 2 | Ra | — | Rb | R1 | R2 | R3 | — | Rc |
| 3 | — | Rb | Ra | R1 | R2 | R3 | — | Rc |
| 4 | — | Rb | Ra | R1 | R2 | R3 | Rc | — |

During sequence 1, which commences at the start of the cycle, all of the reactors are operating up to the time at which the permutable hydrodemetallization guard reactor Ra is deactivated and/or clogged. Ra is then taken off line during sequence 2 in order to discharge the spent catalyst (previously rinsed in situ via the conditioning section), then to recharge fresh or regenerated catalyst (which has been sulphurized ex situ or in situ via the conditioning section). In sequence 3, the permutable reactor Ra is put back on line downstream of the permutable reactor Rb, i.e. a permutation has been carried out. After a certain time, the reactors reach, on average, a critical temperature due to the catalytic deactivation of all of the catalysts, and it is then time in sequence 4 to stop the by-passable hydrocracking reactor Rc until the end of the cycle, in order to control the production of sediments, in particular potential sediments. During the next cycle, it is possible to restart with the permutable hydrodemetallization reactor Rb at the head. It is also possible to retain all or a portion of the catalysts of the preceding cycle if they have not been completely deactivated which may, for example, be the case if a permutable hydrodemetallization reactor is put back on line shortly before completely stopping the unit. The above table is simply an illustration of the possible sequences, it being understood that the deactivation time for the permutable hydrodemetallization reactors is a function of the feed treated, in particular the metals content. Similarly, the operating period for the permutable reactor hydrocracking section is a function of the feed and the applied severity (temperature and dwell time in particular).

Thus, the order in which the permutable or by-passable reactors are taken off line does not have to be followed, but it is simply necessary to retain the possibility of doing this at any time without completely stopping the unit.

In similar manner, more than 2 permutable reactors may be provided in the permutable reactor hydrodemetallization section, or more than 1 by-passable reactor in the by-passable reactor hydrocracking section. Similarly, more or fewer than 3 fixed bed hydrotreatment reactors may be provided; R1, R2 and R3 are shown purely for the purposes of illustration.

DETAILED DESCRIPTION OF THE INVENTION

The remainder of the text provides information regarding the feed and the various steps of the process of the invention.

The Feed

The feed treated in the process in accordance with the invention is advantageously a hydrocarbon feed with an initial boiling temperature of at least 340° C. and a final boiling temperature of at least 440° C. Preferably, its initial boiling temperature is at least 350° C., preferably at least 375° C., and its final boiling temperature is at least 450° C., preferably at least 460° C., more preferably at least 500° C., and yet more preferably at least 600° C.

The hydrocarbon feed in accordance with the invention may be selected from atmospheric residues, straight run vacuum residues, crude oils, topped crude oils, deasphalting resins, asphalts or deasphalted pitches, residues obtained from conversion processes, aromatic extracts obtained from production lines for lubricant bases, bituminous sands or their derivatives, oil shales or their derivatives and source rock oils or their derivatives, used alone or as a mixture. In the present invention, the feeds which are treated are preferably atmospheric residues or vacuum residues, or mixtures of these residues.

The hydrocarbon feed treated in the process may contain sulphur-containing impurities, inter alia. The sulphur content may be at least 0.1% by weight, preferably at least 0.5% by weight, more preferably at least 1% by weight, yet more preferably at least 2% by weight.

The hydrocarbon feed treated in the process may contain metallic impurities inter alia, in particular nickel and vanadium. The sum of the nickel and vanadium contents is generally at least 10 ppm, preferably at least 50 ppm, more preferably at least 100 ppm.

These feeds may advantageously be used as they are. Alternatively, they may be diluted in a co-feed. This co-feed may be a hydrocarbon fraction or a mixture of lighter hydrocarbon fractions which are preferably selected from products obtained from a fluid catalytic cracking process (FCC, Fluid Catalytic Cracking), a light oil cut (LCO), a heavy oil cut (HCO), a decanted oil (DO), a FCC residue, a diesel fraction, in particular a fraction obtained by atmospheric distillation or vacuum distillation, such as vacuum diesel, for example, or may originate from another refining process such as cokefaction or visbreaking.

The co-feed may also advantageously be one or more cuts obtained from a process for the liquefaction of coal or biomass, aromatic extracts, or any other hydrocarbon cuts, or indeed non-oil feeds such as pyrolysis oil. The heavy hydrocarbon feed in accordance with the invention may represent at least 50%, preferably 70%, more preferably at least 80% and yet more preferably at least 90% by weight of the total hydrocarbon feed treated by the process in accordance with the invention.

In certain cases, the co-feed may be introduced downstream of the first bed or the subsequent beds, for example to the inlet to the fixed bed hydrotreatment section, or in fact to the inlet to the by-passable reactor hydrocracking section.

The process in accordance with the invention may be used to obtain conversion products, in particular distillates, and a heavy hydrocarbon fraction with a low sulphur content. This heavy hydrocarbon fraction may be produced in a manner such that its sediments content after aging is 0.1% by weight or less, this being enabled by means of a stoppage (circuit or by-pass) of at least one reactor of the by-passable reactor hydrocracking section.

Optional Step a) for Hydrodemetallization with Permutable Guard Reactors.

During the optional hydrodemetallization step a), the feed and hydrogen are brought into contact over a hydrodemetallization catalyst charged into at least two permutable reactors, under hydrodemetallization conditions. This optional step a) is preferably carried out when the feed contains more than 50 ppm, or even more than 100 ppm of metals and/or when the feed comprises impurities which are susceptible of inducing clogging of the catalytic bed which is too fast, such as iron or calcium derivatives, for example. The aim is to reduce the impurities content and thus to protect the downstream hydrotreatment step from deactivation and clogging—whence the notion of guard reactors. These hydrodemetallization guard reactors are operated as permutable reactors (PRS technology, standing for "Permutable Reactor System"), as described in the patent FR 2 681 871.

These permutable reactors are generally fixed beds located upstream of the fixed bed hydrotreatment section and equipped with lines and valves so that they can be permutated, i.e. for a system with two permutable reactors, Ra and Rb, Ra may be in front of Rb, and vice versa. Each reactor Ra, Rb may be taken off line in order to change the catalyst without stopping the rest of the unit. This change of catalyst (rinsing, discharging, recharging, sulphurization then restarting) is generally carried out by means of a conditioning section (system of equipment outside the principal high pressure loop). The permutation to change the catalyst is carried out when the catalyst is no longer sufficiently active (poisoned by the metals and coking) and/or the clogging reaches a pressure drop which is too high.

In a variation, there may be more than 2 permutable reactors in the permutable reactor hydrodemetallization section.

During the hydrodemetallization step a), hydrodemetallization reactions occur (routinely known as HDM), but also hydrodesulphurization reactions (routinely known as HDS), hydrodenitrogenation reactions (routinely known as HDN) accompanied by hydrogenation, hydrodeoxygenation, hydrodearomatization, hydroisomerization, hydrodealkylation, hydrocracking, hydrodeasphalting reactions and Conradson carbon reduction. Step a) is termed hydrodemetallization because it eliminates the majority of the metals in the feed.

The permutable reactor hydrodemetallization step a) in accordance with the invention may advantageously be carried out at a temperature in the range 300° C. to 500° C., preferably in the range 350° C. to 430° C., and at an absolute pressure in the range 5 MPa to 35 MPa, preferably in the range 11 MPa to 26 MPa, more preferably in the range 14 MPa to 20 MPa. The temperature is usually adjusted as a function of the desired level of hydrodemetallization and the envisaged duration of the treatment. Usually, the space velocity of the hydrocarbon feed, routinely known as HSV, and which is defined as the volumetric flow rate of the feed divided by the total volume of catalyst, may be in the range 0.1 $h^{-1}$ to 5 $h^{-1}$, preferably 0.15 $h^{-1}$ to 3 $h^{-1}$, and more preferably 0.2 $h^{-1}$ to 2 $h^{-1}$.

The quantity of hydrogen mixed with the feed may be in the range 100 and 5000 normal cubic metres ($Nm^3$) per cubic metre ($m^3$) of liquid feed, preferably in the range 200 $Nm^3/m^3$ to 2000 $Nm^3/m^3$, and more preferably in the range 300 $Nm^3/m^3$ to 1000 $Nm^3/m^3$. The permutable reactor hydrodemetallization step a) may be carried out on an industrial scale in at least two fixed bed reactors and preferably with a downflow of liquid.

The hydrodemetallization catalysts are preferably known catalysts. They may be granular catalysts comprising, on a support, at least one metal or metallic compound with a hydrodehydrogenating function. These catalysts may advantageously be catalysts comprising at least one metal from group VIII, generally selected from the group constituted by nickel and cobalt, and/or at least one metal from group VIB, preferably molybdenum and/or tungsten. As an example, a catalyst may be used which comprises 0.5% to 10% by weight of nickel, preferably 1% to 5% by weight of nickel (expressed as nickel oxide, NiO) and 1% to 30% by weight of molybdenum, preferably 3% to 20% by weight of molybdenum (expressed as molybdenum oxide, $MoO_3$) on a mineral support. This support may, for example, be selected from the group constituted by alumina, silica, silica-aluminas, magnesia, clays and mixtures of at least two of these minerals. Advantageously, this support may include other doping compounds, in particular oxides selected from the group constituted by boron oxide, zirconia, cerine, titanium oxide, phosphoric anhydride and a mixture of these oxides. Usually, an alumina support is used, and more usually an alumina support doped with phosphorus and optionally with boron. When phosphoric anhydride, $P_2O_5$, is present, its concentration is less than 10% by weight. When boron trioxide $B_2O_5$, is present, its concentration is less than 10% by weight. The alumina used may be a γ (gamma) alumina or η (eta) alumina. This catalyst is usually in the form of extrudates. The total content of oxides of metals from groups VIB and VIII may be 5% to 40% by weight, preferably 5% to 30% by weight, and the weight ratio, expressed as the metallic oxide, between the metal (or metals) from group VIB and the metal (or metals) from group VIII is in general in the range 20 to 1, and usually in the range 10 to 2.

Examples of catalysts which may be used in the permutable reactor hydrodemetallization step a) are indicated in the patent documents EP 0 113 297, EP 0 113 284, U.S. Pat. Nos. 5,221,656, 5,827,421, 7,119,045, 5,622,616 and 5,089,463.

Step b) for Fixed Bed Hydrotreatment

The effluent obtained from the optional hydrodemetallization step a) is introduced, optionally with hydrogen, into a fixed bed hydrotreatment step b) in order to be brought into contact over at least one hydrotreatment catalyst.

In the absence of the optional permutable guard reactor hydrodemetallization step a), the feed and the hydrogen are introduced directly into the fixed bed hydrotreatment step b) to be brought into contact over at least one hydrotreatment catalyst Ce, or these hydrotreatment catalyst(s) are used in at least one fixed bed reactor and preferably with a downflow of liquid.

The term "hydrotreatment", routinely known as HDT, is intended to mean catalytic treatments with the addition of hydrogen in order to refine, i.e. substantially reduce, the contents of the metals, sulphur and other impurities, in hydrocarbon feeds, and at the same time to improve the hydrogen to carbon ratio of the feed and to transform a greater or lesser proportion of the feed into lighter cuts. The hydrotreatment in particular includes hydrodesulphurization reactions (routinely known as HDS), hydrodenitrogenation reactions (routinely known as HDN) and hydrodemetallization reactions (routinely known as HDM), accompanied by hydrogenation, hydrodeoxygenation, hydrodearomatization, hydroisomerization, hydrodealkylation, hydrocracking, hydrodeasphalting and Conradson carbon reduction.

In accordance with a preferred variation, the hydrotreatment step b) comprises a first step b1) for hydrodemetallization (HDM) carried out in one or more fixed bed hydrodemetallization zones and a subsequent second step b2) for hydrodesulphurization (HDS) carried out in one or more fixed bed hydrodesulphurization zones. During said first step b1) for hydrodemetallization, the effluent from step a), or the feed and hydrogen in the absence of a step a), are brought into contact over a hydrodemetallization catalyst under hydrodemetallization conditions, then during said second step b2) for hydrodesulphurization, the effluent from the first step b1) for hydrodemetallization is brought into contact with a hydrodesulphurization catalyst, under hydrodesulphurization conditions. This process, known by the name of HYVAHL-F™, has been described in the patent U.S. Pat. No. 5,417,846, for example.

The person skilled in the art will readily understand that in the hydrodemetallization step b1), hydrodemetallization reactions are carried out, but at the same time a proportion of the other hydrotreatment reactions will occur, in particular hydrodesulphurization and hydrocracking. Similarly, in the hydrodesulphurization step b2), hydrodesulphurization reactions are carried out, but at the same time, a proportion of the other hydrotreatment reactions will occur, and in particular hydrodemetallization and hydrocracking.

The person skilled in the art will sometimes define a transition zone in which all of the types of hydrotreatment reactions occur. In accordance with this other variation, the hydrotreatment step b) comprises a first step b1) for hydrodemetallization (HDM) carried out in one or more fixed bed hydrodemetallization zones, a subsequent second step b2) for transition carried out in one or more fixed bed transition zones, and a subsequent third step b3) for hydrodesulphurization (HDS) carried out in one or more fixed bed hydrodesulphurization zones. During said first step b1) for hydrodemetallization, the effluent from step a), or the feed and hydrogen in the absence of step a), are brought into contact over a hydrodemetallization catalyst under hydrodemetallization conditions, then during said second step b2) for transition, the effluent from the first step b1) for hydrodemetallization is brought into contact with a transition catalyst under transition conditions, then during said third step b3) for hydrodesulphurization, the effluent from the second step b2) for transition is brought into contact with a hydrodesulphurization catalyst under hydrodesulphurization conditions.

The hydrodemetallization step b1) in accordance with the above variations is particularly necessary in the case in which the permutable guard reactor hydrodemetallization step a) is absent, so that the impurities can be treated and the downstream catalysts can be protected. The necessity for a hydrodemetallization step b1) in accordance with the above variations in addition to the permutable guard reactor hydrodemetallization step a) is justified when the hydrodemetallization carried out during step a) is not sufficient to protect the catalysts of step b), in particular the hydrodesulphurization catalysts.

The hydrotreatment step b) in accordance with the invention is carried out under hydrotreatment conditions. It may advantageously be carried out at a temperature in the range 300° C. to 500° C., preferably in the range 350° C. to 430° C. and at an absolute pressure in the range 5 MPa to 35 MPa, preferably in the range 11 MPa to 26 MPa, preferably in the range 14 MPa to 20 MPa. The temperature is usually adjusted as a function of the desired degree of hydrotreatment and the envisaged treatment period. Usually, the space velocity of the hydrocarbon feed, routinely known as the HSV, and which is defined as the volumetric flow rate of the feed divided by the total volume of catalyst, may be in the range from 0.1 $h^{-1}$ to 5 $h^{-1}$, preferably from 0.1 $h^{-1}$ to 2 $h^{-1}$, and more preferably from 0.1 $h^{-1}$ to 1 $h^{-1}$. The quantity of hydrogen mixed with the feed may be in the range 100 to 5000 normal cubic metres ($Nm^3$) per cubic metre ($m^3$) of liquid feed, preferably in the range 200 $Nm^3/m^3$ to 2000 $Nm^3/m^3$, and more preferably in the range 300 $Nm^3/m^3$ to 1500 $Nm^3/m^3$. The hydrotreatment step b) may be carried out on an industrial scale in one or more reactors with a downflow of liquid.

The hydrotreatment catalysts are preferably known catalysts. They may be granular catalysts comprising, on a support, at least one metal or metallic compound with a hydrodehydrogenating function. These catalysts may advantageously be catalysts comprising at least one metal from group VIII, generally selected from the group constituted by nickel and cobalt, and/or at least one metal from group VIB, preferably molybdenum and/or tungsten. As an example, a catalyst may be used which comprises 0.5% to 10% by weight of nickel, preferably 1% to 5% by weight of nickel (expressed as nickel oxide, NiO) and 1% to 30% by weight of molybdenum, preferably 3% to 20% by weight of molybdenum (expressed as molybdenum oxide, $MoO_3$) on a mineral support. This support may, for example, be selected from the group constituted by alumina, silica, silica-aluminas, magnesia, clays and mixtures of at least two of these minerals.

Advantageously, this support may include other doping compounds, in particular oxides selected from the group constituted by boron oxide, zirconia, cerine, titanium oxide, phosphoric anhydride and a mixture of these oxides. Usually, an alumina support is used, and more usually an alumina support doped with phosphorus and optionally with boron. When phosphoric anhydride, $P_2O_5$, is present, its concentration is less than 10% by weight. When boron trioxide $B_2O_5$, is present, its concentration is less than 10% by weight. The alumina used may be a γ (gamma) alumina or η (eta) alumina. This catalyst is usually in the form of extrudates. The total content of oxides of metals from groups VIB and VIII may be 3% to 40% by weight, in general 5% to 30% by weight, and the weight ratio, expressed as the metallic oxide, between the metal (or metals) from group VIB and the metal (or metals) from group VIII is in general in the range 20 to 1, and usually in the range 10 to 2.

In the case of a hydrotreatment step including a step b1) for hydrodemetallization (HDM) then a step b2) for hydrodesulphurization (HDS), catalysts which are specifically adapted to each step are preferably used. Examples of catalysts which may be used in the hydrodemetallization step b1) are indicated in the patent documents EP 0 113 297, EP 0 113 284, U.S. Pat. Nos. 5,221,656, 5,827,421, 7,119,045, 5,622,616 and 5,089,463. Examples of catalysts which may be used in the hydrodesulphurization step b2) are indicated in the patent documents EP 0 113 297, EP 0 113 284, U.S. Pat. Nos. 6,589,908, 4,818,743 or 6,332,976. It is also possible to use a mixed catalyst, also known as a transition catalyst, which is active for hydrodemetallization and hydrodesulphurization, both for the hydrodemetallization section b1) and for the hydrodesulphurization section b2), as described in the patent document FR 2 940 143.

In the case of a hydrotreatment step including a hydrodemetallization step b1) (HDM) then a step b2) for transition, then a step b3) for hydrodesulphurization (HDS), catalysts which are specifically adapted to each step are preferably used. Examples of catalysts which may be used in the hydrodemetallization step b1) are indicated in the patent documents EP 0 113 297, EP 0 113 284, U.S. Pat. Nos. 5,221,656, 5,827,421, 7,119,045, 5,622,616 and 5,089,463. Examples of catalysts which may be used in the transition step b2), which are active for hydrodemetallization and hydrodesulphurization, are described in the patent document FR 2 940 143. Examples of catalysts which may be used in the hydrodesulphurization step b3) are indicated in the patent documents EP 0 113 297, EP 0 113 284, U.S. Pat. Nos. 6,589,908, 4,818,743 or 6,332,976. It is also possible to use a transition catalyst as described in the patent document FR 2 940 143 for sections b1), b2) and b3).

Step c) for Hydrocracking in by-Passable Reactors

The effluent obtained from the hydrotreatment step b) is introduced into a step c) for hydrocracking in by-passable reactors. Hydrogen may also be injected upstream of the various catalytic beds making up the by-passable hydrocracking reactors. At the same time as the thermal cracking and hydrocracking reactions which are desired in this step, all types of hydrotreatment reactions (HDM, HDS, HDN, etc) also occur. The specific conditions, primarily temperature, and/or the use of one or more specific catalysts mean that the desired cracking or hydrocracking reactions can be favoured.

The hydrocracking step c) reactors are used as by-passable reactors. The term "by-passable reactors" means a system of at least one reactor which can be stopped by implementing a by-pass (short circuiting using lines and valves), while the other reactor (or reactors) of the unit (either the hydrodemetallization section and/or the hydrotreatment section) is (are) operating. In contrast to reactors which are said to be permutable, which can be put back into service while the other reactor (or reactors) of the unit is (are) operating, by-passable reactors do not have this facility (or in fact being put back into service is not desirable); they will be put back into service during a restart of the entire unit.

In accordance with a variation which is not preferred, more than 1 by-passable reactor may be provided in the by-passable reactor hydrocracking section.

The hydrocracking step c) in accordance with the invention is operated under hydrocracking conditions. It may advantageously be operated at a temperature in the range 340° C. to 480° C., preferably in the range 350° C. to 430° C., under an absolute pressure in the range 5 MPa to 35 MPa, preferably in the range 11 MPa to 26 MPa, more preferably in the range 14 MPa to 20 MPa. The temperature is usually adjusted as a function of the desired level of hydrocracking and of the envisaged treatment period. Preferably, the mean temperature at the start of the hydrocracking step c) cycle in by-passable reactors is permanently higher by at least 5° C., preferably by at least 10° C., more preferably by at least 15° C. than the mean temperature at the start of the hydrotreatment step b) cycle. This difference may reduce during the cycle due to the increase in the temperature of the hydrotreatment step b) in order to compensate for catalytic deactivation. Overall, the mean temperature over the whole of the by-passable reactor hydrocracking step c) cycle is permanently higher by at least 5° C. than the mean temperature over the whole of the hydrotreatment step b) cycle.

Usually, the space velocity of the hydrocarbon feed, routinely known as the HSV, and which is defined as the volumetric flow rate of the feed divided by the total volume of catalyst, may be in the range from 0.1 $h^{-1}$ to 5 $h^{-1}$, preferably from 0.2 $h^{-1}$ to 2 $h^{-1}$, and more preferably from 0.25 $h^{-1}$ to 1 $h^{-1}$. The quantity of hydrogen mixed with the feed may be in the range 100 to 5000 normal cubic metres ($Nm^3$) per cubic metre ($m^3$) of liquid feed, preferably in the range 200 $Nm^3/m^3$ to 2000 $Nm^3/m^3$, and more preferably in the range 300 $Nm^3/m^3$ to 1500 $Nm^3/m^3$. The hydrocracking step c) may be carried out on an industrial scale in at least one fixed bed reactor, and preferably with a downflow of liquid.

The hydrocracking catalysts used may be hydrocracking or hydrotreatment catalysts. They may be granular catalysts in the form of extrudates or beads comprising, on a support, at least one metal or metallic compound with a hydrodehydrogenating function. These catalysts may advantageously be catalysts comprising at least one metal from group VIII, generally selected from the group constituted by nickel and cobalt, and/or at least one metal from group VIB, preferably molybdenum and/or tungsten. As an example, a catalyst may be used which comprises 0.5% to 10% by weight of nickel, preferably 1% to 5% by weight of nickel (expressed as nickel oxide, NiO) and 1% to 30% by weight of molybdenum, preferably 5% to 20% by weight of molybdenum (expressed as molybdenum oxide, $MoO_3$) on a mineral support. This support may, for example, be selected from the group constituted by alumina, silica, silica-aluminas, magnesia, clays and mixtures of at least two of these minerals. Advantageously, this support may include other doping compounds, in particular oxides selected from the group constituted by boron oxide, zirconia, cerine, titanium oxide, phosphoric anhydride and a mixture of these oxides. Usually, an alumina support is used, and more usually an alumina support doped with phosphorus and optionally with boron. When phosphoric anhydride, $P_2O_5$, is present, its concentration is less than 10% by weight. When boron trioxide $B_2O_5$, is present, its concentration is less than 10% by weight. The alumina used may be a γ (gamma) alumina or η (eta) alumina. This catalyst is usually in the form of extrudates. The total content of oxides of metals from groups VIB and VIII may be 5% to 40% by weight, and in general 7% to 30% by weight, and the weight ratio, expressed as the metallic oxide, between the metal (or metals) from group VIB and the metal (or metals) from group VIII is in general in the range 20 to 1, and usually in the range 10 to 2.

Alternatively, part or all of the hydrocracking step may advantageously make use of a bifunctional catalyst with a hydrogenating phase in order to be able to hydrogenate the aromatics and produce an equilibrium between the saturated compounds and the corresponding olefins, and an acidic phase which can be used to promote the hydroisomerization and hydrocracking reactions. The acidic function is advantageously provided by supports with large surface areas (generally 100 to 800 $m^2/g$) with a superficial acidity, such as halogenated aluminas (mainly chlorinated or fluorinated), combinations of oxides of boron and aluminium, amorphous silica-aluminas and zeolites. The hydrogenating function is advantageously provided either via one or more metals from group VIII of the periodic classification of the elements such as iron, cobalt, nickel, ruthenium, rhodium, palladium, osmium, iridium or platinum, or by an association of at least one metal from group VIB of the periodic classification of the elements, such as molybdenum or tungsten, and at least one non-noble metal from group VIII (such as nickel or cobalt). The catalyst should also advantageously have a high resistance to impurities and asphaltenes, because a heavy feed is used.

Preferably, the bifunctional catalyst used comprises at least one metal selected from the group formed by metals from groups VIII and VIB, used alone or as a mixture, and a support comprising 10% to 90% by weight of a zeolite containing iron and 90% to 10% by weight of inorganic oxides. The metal from group VIB which is used is preferably selected from tungsten and molybdenum, and the metal from group VIII is preferably selected from nickel and cobalt. The bifunctional catalyst is preferably prepared using the preparation method described in Japanese patent application no. 2289 419 (IKC) or EP 0 384 186. Examples of this type of catalyst are described in the patents JP 2966 985, JP 2908 959, JP 01 049399 and JP 61 028717, U.S. Pat. Nos. 4,446,008, 4,622,127, 6,342,152, EP 0 537 500 and EP 0 622118.

In another preferred variation, monofunctional catalysts and bifunctional catalysts of the alumina, amorphous silica-alumina or zeolite type may be used as a mixture or in successive layers.

The use of catalysts analogous to ebullated bed hydrocracking catalysts or bifunctional catalysts in the hydrocracking section is particularly advantageous.

Prior to injecting the feed, the catalysts used in the process in accordance with the present invention preferably undergo an in situ or ex situ sulphurization treatment.

Step d) for Separation of Hydrocracking Effluent

The process in accordance with the invention may also comprise a separation step d) in order to obtain at least one gaseous fraction and at least one heavy liquid fraction.

The effluent obtained from the hydrocracking step c) (or from the hydrotreatment step b) when the by-passable reactor or reactors have been by-passed) comprises a liquid fraction and a gaseous fraction containing gases, in particular $H_2$, $H_2S$, $NH_3$ and C1-C4 hydrocarbons. This gaseous fraction may be separated from the effluent with the aid of separation devices which are well known to the person skilled in the art, in particular with the aid of one or more separating drums which can be operated at different pressures and temperatures, optionally associated with a steam stripping means or hydrogen stripping means and with one or more distillation columns. The effluent obtained from the hydrocracking step c) or from the hydrotreatment step b) when the by-passable reactor or reactors have been by-passed is advantageously separated in at least one separator drum into at least one gaseous fraction and at least one heavy liquid fraction. These separators may, for example, be high pressure high temperature (HPHT) separators and/or high pressure low temperature (HPLT) separators.

After cooling if required, this gaseous fraction is preferably treated in a hydrogen purification means in order to recover the hydrogen which has not been consumed during the hydrotreatment and hydrocracking reactions. The hydrogen purification means may be an amine scrubber, a membrane, a PSA type system, or several of these means disposed in series. The purified hydrogen may then advantageously be recycled to the process in accordance with the invention, after re-compression if necessary. The hydrogen may be introduced into the inlet to the hydrodemetallization step a) and/or to different locations during the hydrotreatment step b) and/or to the inlet to the hydrocracking step c) and/or to various locations during the hydrocracking step c).

The separation step d) may also comprise an atmospheric distillation and/or a vacuum distillation. Advantageously, the separation step d) furthermore comprises at least one atmospheric distillation in which the liquid hydrocarbon fraction(s) obtained after separation is (are) fractionated by atmospheric distillation into at least one atmospheric distillate fraction and at least one atmospheric residue fraction. The atmospheric distillate fraction may contain base fuels (naphtha, kerosene and/or diesel) which can be commercially upgraded, for example in the refinery, for the production of automobile and aviation fuels. The kerosene and/or diesel type fractions may also be used as fluxes and be incorporated into a fuel pool or distillate type or residual type bunker fuel (in accordance with ISO 8217).

Furthermore, the separation step d) of the process in accordance with the invention may advantageously furthermore comprise at least one vacuum distillation in which the liquid hydrocarbon fraction(s) obtained after separation and/or the atmospheric residue fraction obtained after atmospheric distillation is (are) fractionated by vacuum distillation into at least one vacuum distillate fraction and at least one vacuum residue fraction. Preferably, the separation step d) firstly comprises an atmospheric distillation in which the liquid hydrocarbon fraction(s) obtained after separation is (are) fractionated by atmospheric distillation into at least one atmospheric distillate fraction and at least one atmospheric residue fraction, then a vacuum distillation in which the atmospheric residue fraction obtained after atmospheric distillation is fractionated by vacuum distillation into at least one vacuum distillate fraction and at least one vacuum residue fraction. The vacuum distillate fraction typically contains vacuum gas oil type fractions. The vacuum distillate fraction may be upgraded as a marine distillate type fuel (in accordance with ISO 8217) with a very low sulphur content, or in fact it may be incorporated into a pool of the residual bunker fuel type (in accordance with ISO 8217). Advantageously, the vacuum distillate can be sent to a fluidized bed catalytic cracking process or to a fixed bed hydrocracking process.

At least a portion of the atmospheric residue fraction or a portion of the vacuum residue fraction may optionally be recycled to the hydrocracking step c). The atmospheric residue fraction and/or the vacuum residue fraction may be sent to a catalytic cracking process. The atmospheric residue fraction and/or the vacuum residue fraction may be used as a fuel oil or fuel oil base, possibly as a bunker fuel base with a low sulphur content.

A portion of the vacuum residue fraction and/or a portion of the vacuum distillate fraction may be sent to a step for catalytic cracking or ebullated bed hydrocracking. In accordance with a variation, this ebullated bed hydrocracking step is supplied at least in part by a heavy liquid fraction originating from a high pressure high temperature separator.

In accordance with a particular embodiment, a portion of the atmospheric distillate fraction and/or vacuum distillate fraction in accordance with the invention may be left in the heavy liquid hydrocarbon fraction in a manner such that the viscosity of the mixture is directly that of a desired fuel oil grade, for example 180 or 380 cSt at 50° C.

Fluxing

The liquid hydrocarbon fractions, in particular the heavy fractions containing atmospheric residue and/or vacuum residue in accordance with the invention, may advantageously be used at least in part as fuel oil bases or as fuel oil, in particular as a bunker fuel base or as bunker fuel with a sediments content (after aging) or 0.1% by weight or less.

The term "fuel oil" as used in the invention means a hydrocarbon fraction which can be used as a fuel. The term "fuel oil base" as used in the invention means a hydrocarbon fraction which, when mixed with other bases, constitutes a fuel oil.

In order to obtain a fuel oil, the liquid hydrocarbon fractions obtained from step d) may be mixed with one or more fluxing bases selected from the group constituted by catalytically cracked light cut oils, catalytically cracked heavy cut oils, catalytically cracked residue, a kerosene, a diesel, a vacuum distillate and/or a decanted oil. Preferably, kerosene, gas oil and/or a vacuum distillate produced in the process of the invention will be used.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 16/55.287, filed Jun. 9, 2016 are incorporated by reference herein.

EXAMPLE

Example 1

(not in Accordance with the Invention)

The feed was a mixture of atmospheric residues (AR) of Middle Eastern origin. This mixture was characterized by a large quantity of metals (100 ppm by weight) and sulphur (4.0% by weight) as well as 7% of [370-].

The hydrotreatment process comprised the use of three fixed bed reactors (R1, R2 and R3) with a downflow of liquid within which the steps termed hydrodemetallization (HDM) and hydrotreatment (HDT) were carried out.

The effluent obtained from these two steps was flash separated in order to obtain a liquid fraction and a gaseous fraction containing gases, in particular $H_2$, $H_2S$, $NH_3$ and C1-C4 hydrocarbons. The liquid fraction was then stripped in a column then fractionated in an atmospheric column then a vacuum column into several cuts (IP-350° C., 350-520° C. and 520° C.+).

The reactor R1 was charged with hydrodemetallization catalyst and the reactors R2, R3 with hydrotreatment catalyst. The process was carried out under a partial pressure of hydrogen of 15 MPa, a reactor temperature at the start of the cycle of 360° C. and 420° C. at the end of the cycle.

Table 1 below shows the hourly space velocities (HSV) for each catalytic reactor and the corresponding mean temperatures (WABT) obtained over the whole cycle as a function of the described mode of operation.

These conditions were fixed in accordance with the prior art for an operational period of 11 months and a HDM rate of more than 90%.

TABLE 1

Operating conditions for the various sections

| HDM and HDT in fixed bed mode | HSV ($h^{-1}$) | WABT (° C.) |
|---|---|---|
| R1 | 0.50 | 390 |
| R2 | 0.50 | 390 |
| R3 | 0.50 | 390 |
| Total | 0.17 | 390 |

The WABT is a mean temperature over the height of the bed and also averaged over time for the duration of a cycle.

The yields obtained in accordance with the example which was not in accordance with the invention are presented in Table 4 for comparison with the yields in accordance with the example which was in accordance with the invention.

Example 2

(in Accordance with the Invention)

In this example, the process in accordance with the invention was operated with the same feed, the same catalysts and under the same operating conditions for the reactor R1. Reactor R2 was operated under the same operating conditions, but its HSV was higher.

The process in accordance with the invention involved the use of a novel by-passable hydrocracking reactor denoted Rc, replacing the reactor R3 which appeared in the hydrotreatment section (HDT) of the prior art. This hydrocracking step was carried out at high temperature downstream of the hydrodemetallization and fixed bed hydrotreatment steps which were carried out in the reactors R1 and R2.

Table 2 below provides an example of the operation of the by-passable reactor Rc.

TABLE 2

Operations around the by-passable reactor in accordance with the invention

| | Fixed bed reactors | | By-passable hydrocracking reactor | |
|---|---|---|---|---|
| Sequences | HDM/Transition | HDT | Off line | HCK |
| 1 | R1 | R2 | — | Rc |
| 2 | R1 | R2 | Rc | — |

During sequence 1, the effluent obtained from the hydrocracking step was similar in terms of purification to that of Example 1, but the conversion was higher. During sequence 2, the effluent obtained was slightly degraded in terms of purification, but similar in terms of conversion.

The reactor Rc of the hydrocracking step was charged with a hydrocracking catalyst.

The process was carried out under a partial pressure of hydrogen of 15 MPa, a reactor temperature at the start of the cycle of 390° C., and 420° C. at the end of the cycle.

Once the temperature of 420° C. had been reached in the by-passable reactor, the reactor Rc was taken off line until the end of the cycle using a by-pass, in order to limit the formation of sediments.

Table 3 below shows the hourly space velocity (HSV) for each catalytic reactor and the corresponding average temperatures (WABT) obtained for the whole of the cycle, as a function of the embodiment described.

TABLE 3

Operating conditions for the various sections

| | HSV ($h^{-1}$) | WABT (° C.) |
|---|---|---|
| HDM and HDT, fixed bed | | |
| R1 | 0.50 | 390 |
| R2 | 0.40 | 390 |
| By-passable HCK | | |
| Rc | 0.67 | 405 |
| Total | 0.17 | 394 |

Table 4 below compares the yields and hydrogen consumption obtained in accordance with the example not in accordance with the invention and in accordance with the example in accordance with the invention.

TABLE 4

Comparison of mean yields obtained during cycle

| | Example, not in accordance | Example, in accordance |
|---|---|---|
| WABT, mean (° C.) | 390 | 394 |
| Cons. $H_2$ | 1.67 | 1.77 |
| Yields | | |
| $H_2S$ | 3.94 | 3.94 |
| $NH_3$ | 0.24 | 0.24 |
| C1-C4 | 1.61 | 1.86 |
| IP-350° C. | 17.9 | 18.8 |
| 350° C.-520° C. | 40.2 | 42.1 |
| 520° C.+ | 37.8 | 34.9 |
| Total | 101.67 | 101.77 |

Thus, it appears that, according to Tables 2, 3 and 4, the process in accordance with the invention, integrating a hydrocracking section with a by-passable reactor Rc, can be used to increase the mean WABT of the cycle by +4° C. for an identical overall HSV. The WABT is the average bed temperature during a cycle.

The HSV is the ratio of the volumetric flow rate of feed to the volume of catalyst contained in the reactor.

According to Table 4, the gain obtained in terms of WABT (+4° C.) translates into an increase in the yields of the most upgradable cuts: +0.9 points for the [IP-350° C.] cut and +1.9 points for the [350° C.–520° C.] cut.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A continuous process for the treatment of a hydrocarbon feed containing at least one hydrocarbon fraction with a sulphur content of at least 0.1% by weight, an initial boiling temperature of at least 340° C. and a final boiling temperature of at least 440° C., the process comprising:

a) hydrodemetallization in which at least two permutable reactors are operated at a temperature in the range 300° C. to 500° C., and under an absolute pressure in the range 5 MPa to 35 MPa, in the presence of the hydrocarbon feed and hydrogen, and a hydrodemetallization catalyst, b) fixed bed hydrotreatment, in at least one reactor in which the effluent obtained from a) when is brought into contact with at least one hydrotreatment catalyst at a temperature in the range 300° C. to 500° C. and under an absolute pressure in the range 5 MPa to 35 MPa, c) fixed bed hydrocracking, in at least one by-passable reactor under an absolute pressure in the range 5 MPa to 35 MPa, in the presence of effluent obtained from b), and a hydrocracking catalyst, in which said by-passable reactor for the fixed bed hydrocracking is stopped as soon as the temperature of said by-passable reactor is between 390° C. and 430° C., d) separating effluent obtained from hydrocracking in c) in order to obtain at least one gaseous fraction and at least one heavy liquid fraction, said heavy liquid fraction being sent to an atmospheric distillation producing at least one atmospheric distillate and an atmospheric residue, a portion or the entirety of said atmospheric residue being sent to a vacuum distillation producing a vacuum residue, said atmospheric and vacuum residues optionally being sent to a catalytic cracking process or being used as a fuel oil or fuel oil base.

2. The process for the treatment of a hydrocarbon feed as claimed in claim 1, in which said by-passable reactor for the fixed bed hydrocracking is stopped as soon as the temperature of said by-passable reactor is between 405° C. and 425° C.

3. The process for the treatment of a hydrocarbon feed as claimed in claim 1, in which the hydrodemetallization a) is carried out under the following operating conditions:

a temperature in the range 350° C. to 430° C., an absolute pressure in the range 11 MPa to 26 MPa, a HSV (defined as the volumetric flow rate of the feed divided by the total volume of catalyst) in the range 0.1 $h^{-1}$ to 5 $h^{-1}$.

4. The process for the treatment of a hydrocarbon feed as claimed in claim 1, in which the hydrodemetallization a) employs a hydrodemetallization catalyst comprising 0.5% to 10% by weight of nickel, (expressed as nickel oxide, NiO), and 1% to 30% by weight of molybdenum, (expressed as molybdenum oxide, $MoO_3$) on a mineral support.

5. The process for the treatment of a hydrocarbon feed as claimed in claim 1, in which the hydrotreatment b) is carried out at a temperature in the range 350° C. to 430° C., and under an absolute pressure in the range 11 MPa to 26 MPa.

6. The process for the treatment of a hydrocarbon feed as claimed in claim 1, in which the hydrotreatment b) uses a catalyst comprising 0.5% to 10% by weight of nickel, (expressed as nickel oxide NiO), and 1% to 30% by weight of molybdenum (expressed as molybdenum oxide, $MoO_3$) on a mineral support of alumina, silica, silica-alumina, magnesia, clay or mixtures of at least two thereof.

7. The process for the treatment of a hydrocarbon feed as claimed in claim 1, in which the hydrocracking c) is carried out at a temperature in the range 350° C. to 430° C., and under an absolute pressure in the range 11 MPa to 26 MPa.

8. The process for the treatment of a hydrocarbon feed as claimed in claim 1, in which the hydrocracking c) employs a catalyst comprising 0.5% to 10% by weight of nickel (expressed as nickel oxide, NiO), and 1% to 30% by weight of molybdenum (expressed as molybdenum oxide, $MoO_3$) on a mineral support of alumina, silica, silica-alumina, magnesia, clay or mixtures of at least two thereof.

9. The process for the treatment of a hydrocarbon feed as claimed in claim 1, in which the separation d) comprises at least one atmospheric distillation obtaining at least one atmospheric distillate and at least one atmospheric residue, said atmospheric residue being sent to a catalytic cracking process.

10. The process for the treatment of a hydrocarbon feed as claimed in claim 1, in which the separation d) comprises at least one vacuum distillation obtaining at least one vacuum distillate and at least one vacuum residue.

11. The process for the treatment of a hydrocarbon feed as claimed in claim 1, in which the hydrodemetallization a) is carried out under the following operating conditions:

a temperature in the range 350° C. to 430° C., an absolute pressure in the range 14 MPa to 20 MPa, a HSV (defined as the volumetric flow rate of the feed divided by the total volume of catalyst) in the range 0.15 $h^{-1}$ to 3 $h^{-1}$.

12. The process for the treatment of a hydrocarbon feed as claimed in claim 1, in which the hydrodemetallization a) employs a hydrodemetallization catalyst comprising 1% to 5% by weight of nickel, (expressed as nickel oxide, NiO), and 3% to 20% by weight of molybdenum, (expressed as molybdenum oxide, $MoO_3$) on a mineral support.

13. The process for the treatment of a hydrocarbon feed as claimed in claim 1, in which the hydrotreatment b) uses a catalyst comprising 1% to 5% by weight of nickel, (expressed as nickel oxide NiO), and 5% to 20% by weight of molybdenum (expressed as molybdenum oxide, $MoO_3$) on a mineral support of alumina, silica, silica-alumina, magnesia, clay or mixtures of at least two thereof.

14. The process for the treatment of a hydrocarbon feed as claimed in claim 1, in which the hydrocracking c) is carried out at a temperature in the range 350° C. to 430° C., and under an absolute pressure in the range of 14 MPa to 20 MPa.

15. The process for the treatment of a hydrocarbon feed as claimed in claim 1, in which the hydrocracking c) employs a catalyst comprising 1% to 5% by weight of nickel (expressed as nickel oxide, NiO) and 5% to 20% by weight of molybdenum (expressed as molybdenum oxide, $MoO_3$) on a mineral support of alumina, silica, silica-alumina, magnesia, clay or mixtures of at least two thereof.

* * * * *